United States Patent [19]

Hüsges et al.

[11] 4,132,056

[45] Jan. 2, 1979

[54] OPEN END SPINNING APPARATUS

[75] Inventors: Gerd Hüsges; Eberhard Grimm, both of Ingolstadt, Fed. Rep. of Germany

[73] Assignee: Schubert & Salzer, Ingolstadt, Fed. Rep. of Germany

[21] Appl. No.: 750,130

[22] Filed: Dec. 13, 1976

[30] Foreign Application Priority Data

Dec. 23, 1975 [DE] Fed. Rep. of Germany ..... 2558419
Mar. 25, 1976 [CH] Switzerland ..... 3711/76

[51] Int. Cl.[2] ..... D01H 15/00

[52] U.S. Cl. ..... 57/263; 57/58.95; 242/47.12

[58] Field of Search ..... 57/58.89–58.95, 57/34 R; 242/47.08–47.13

[56] References Cited

U.S. PATENT DOCUMENTS

| | | | |
|---|---|---|---|
| 3,334,479 | 8/1967 | Mikulecky et al. | 57/34 R |
| 3,455,095 | 7/1969 | Margham et al. | 57/34 R |
| 3,492,804 | 2/1970 | Landwehrkamp et al. | 57/58.89 X |
| 3,695,017 | 10/1972 | Hoki et al. | 57/34 R |
| 3,749,327 | 7/1973 | Roethke et al. | 242/47.12 |
| 3,810,352 | 5/1974 | Miyazaki et al. | 57/34 R |
| 3,816,990 | 6/1974 | Hoffmann et al. | 57/34 R X |
| 3,842,579 | 10/1974 | Bartling | 57/34 R |
| 3,854,274 | 12/1974 | Bartling | 57/34 R |
| 3,924,393 | 12/1975 | Stahlecker et al. | 57/34 R |
| 3,925,975 | 12/1975 | Stahlecker et al. | 57/34 R |
| 3,938,306 | 2/1976 | Bous | 57/34 R |
| 3,999,362 | 12/1976 | Schulz et al. | 57/34 R |

FOREIGN PATENT DOCUMENTS 144459 6/1972 Czechoslovakia.

*Primary Examiner*—John Petrakes
*Attorney, Agent, or Firm*—Bailey, Dority & Flint

[57] ABSTRACT

An open-end spinning device wherein yarn is produced in a spinning compartment and withdrawn therefrom by yarn-withdrawal rollers and a winding device. The yarn storage device is interposed between the yarn-withdrawal rollers and the winding device. A knock-off motion is positioned between the spinning compartment and the yarn withdrawal rollers for producing a signal responsive to changes in tension in the yarn. The yarn storage device includes a roller storage which is driven in a forward direction for accumulating a supply of yarn that is to be fed to the winding device. The roller storage can also be rotated in a reverse direction for withdrawing yarn therefrom during a piecing operation. A yarn gripper is provided for gripping the yarn upon a change in tension in the yarn.

10 Claims, 4 Drawing Figures

25
21
26
22
14
40
30
4
6
50
3
5
52
51
2
1
54
53
20
15
11
12
10
13

OPEN END SPINNING APPARATUS

BACKGROUND OF THE INVENTION

The present invention relates to an open-end spinning apparatus and more particularly to an open-end apparatus including a spinning compartment, yarn withdrawal rolls and a winding device. A yarn storage device is disposed between yarn withdrawal rolls and the winding device. A knock-off motion is positioned between the spinning compartment and withdrawal rolls.

It is known to provide a yarn storage device between the delivery rollers and the winding device of an open end spinning apparatus (DT-AS No. 2,221,316, DT-OS No. 2,242,151). In the first case, a long length of yarn cannot be stored for reasons of space. Moreover, there is the risk that the yarn stored in the suction tube will form loops and knots. In the second case, while a large amount of yarn can be stored, it requires a yarn-curling compartment for storing the yarn which alters the appearance of the yarn. Such an alteration of the appearance of the yarn is only acceptable or desirable in the rarest of cases.

It is also known to use so-called roller stores in winding devices (DT-OS No. 2,335,204). In the event of a yarn breakage, however, it is very difficult to find the yarn on the roller store in order to supply it to the spinning apparatus for piecing.

It is also known to connect a yarn gripper to a knock-off motion, which yarn gripper prevents the yarn from leaving the yarn withdrawal tube in the event of a yarn breakage occurring (DT-PS No. 1,560,304), so that piecing can be effected automatically. However, such a device only works at low yarn withdrawal speeds. With the high yarn withdrawal speeds possible today, it is impossible to prevent the yarn from leaving the yarn withdrawal tube in this manner.

SUMMARY OF THE INVENTION

According to the invention, a yarn storage device is constructed in the form of a roller store which is equipped with a re-delivery drive and to which the yarn is supplied continuously. A yarn gripper is under control of a knock-off motion and of a switch member and is positioned between the spinning compartment and the roller store. As a result of the roller store, the appearance of the stored yarn is not impaired. In addition, a relatively large amount of yarn can be stored by means of the roller store. The yarn is supplied to the roller store over a defined yarn path. Between the yarn withdrawal rollers and the roller store, there is a yarn gripper which can be closed depending on the knock-off motion. When the yarn tension drops, the knock-off motion senses the drop in tension and closes the yarn gripper which catches the end of the yarn at a defined point before it reaches the roller store. The yarn gripper is opened by the additional switch member for the re-delivery of the end of the yarn to the spinning apparatus. The re-delivery drive of the roller store permits the withdrawal of the yarn counter to the usual receiving direction. The yarn gripper is preferably disposed between the thread withdrawal rollers and the roller store. In order that the yarn piecing may be carried out automatically, according to a further feature of the invention, the yarn gripper has associated with it a yarn seizer or a yarn guide by means of which the end of the yarn can be supplied automatically to the spinning compartment. Furthermore, in order to obtain a satisfactory piecing end and to obtain always the same length of yarn end regardless of the withdrawal speed, a yarn-cutting device with an associated suction device is provided in the path of the yarn between the withdrawal rollers and the yarn gripper.

According to a preferred embodiment of the invention, the re-delivery drive is constructed in the form of a slip drive, the slip moment of which is preferably adjustable so that an adaptation to various thicknesses of yarn is possible. The slip drive may vary in construction, for example, it may be constructed in the form of a friction clutch, or an eddy-current drive may be used. In order to prevent the roller store from being completely emptied by the winding device during piecing or in the event of other interruptions in the storage process, leading to a yarn breakage between roller store and winding device, according to a further feature of the invention, a monitor which monitors the amount of yarn stored and controls the winding device is associated with the roller store.

An individual winding roller is preferably provided per spinning station, on a winding shaft which extends over a plurality of spinning station, which winding roller can be connected to the winding shaft via a controllable clutch.

According to a particular embodiment, the roller store is disposed substantially transversely to the yarn withdrawal direction and a deflecting device located between the roller store and the winding device deflects the yarn coming from the roller store towards the winding device. In this case, a knotting device with a suction device at its side remote from the deflection point is provided between the deflection point and the winding device, to which knotting device the yarn can be supplied via a feed loop. The knotting device can also be switched off if desired.

In order to influence the winding tightness, the deflection point disposed between the roller store and the winding device is constructed in the form of a yarn brake. The invention can be used to equalize fluctuations during the normal laying of the yarn during winding up, with tapered bobbins or during the bobbin change, or on the interruption of the yarn supply as a result of piecing or knotting operations, etc.

The apparatus, according to the invention, facilitates the commencement of spinning becuse the yarn no longer has to be tediously sought but is in a defined position. Since the yarn is always held taut between the spinning apparatus and the roller store as a result of the slip drive of the roller store, a satisfactory withdrawal of the yarn is ensured even before the yarn is introduced into the nip line of the pair of delivery rollers.

Accordingly, it is an object of the present invention to provide a yarn storage device on an open end spinning machine which does not adversely affect the appearance of the yarn.

Another important object of the present invention is to provide an apparatus for use on open end spinning machines which grasps and holds the yarn at a precise point upon the occurrence of breakage or change in the tension in the yarn.

Still another important object of the present invention is to provide an apparatus for use on open end spinning machines that grasps yarn to hold the end thereof at a precise point so that it can be readily pieced back up.

Still another important object of the present invention is to provide an apparatus for an open end spinning machine which stores yarn intermediate the spinning compartment and winding device so that yarn is available for piecing the yarn back up after a breakage.

These and other objects and advantages of the invention will become apparent upon reference to the following specification, attendant claims, and drawings.

DESCRIPTION OF A PREFERRED EMBODIMENT

Figure 1:
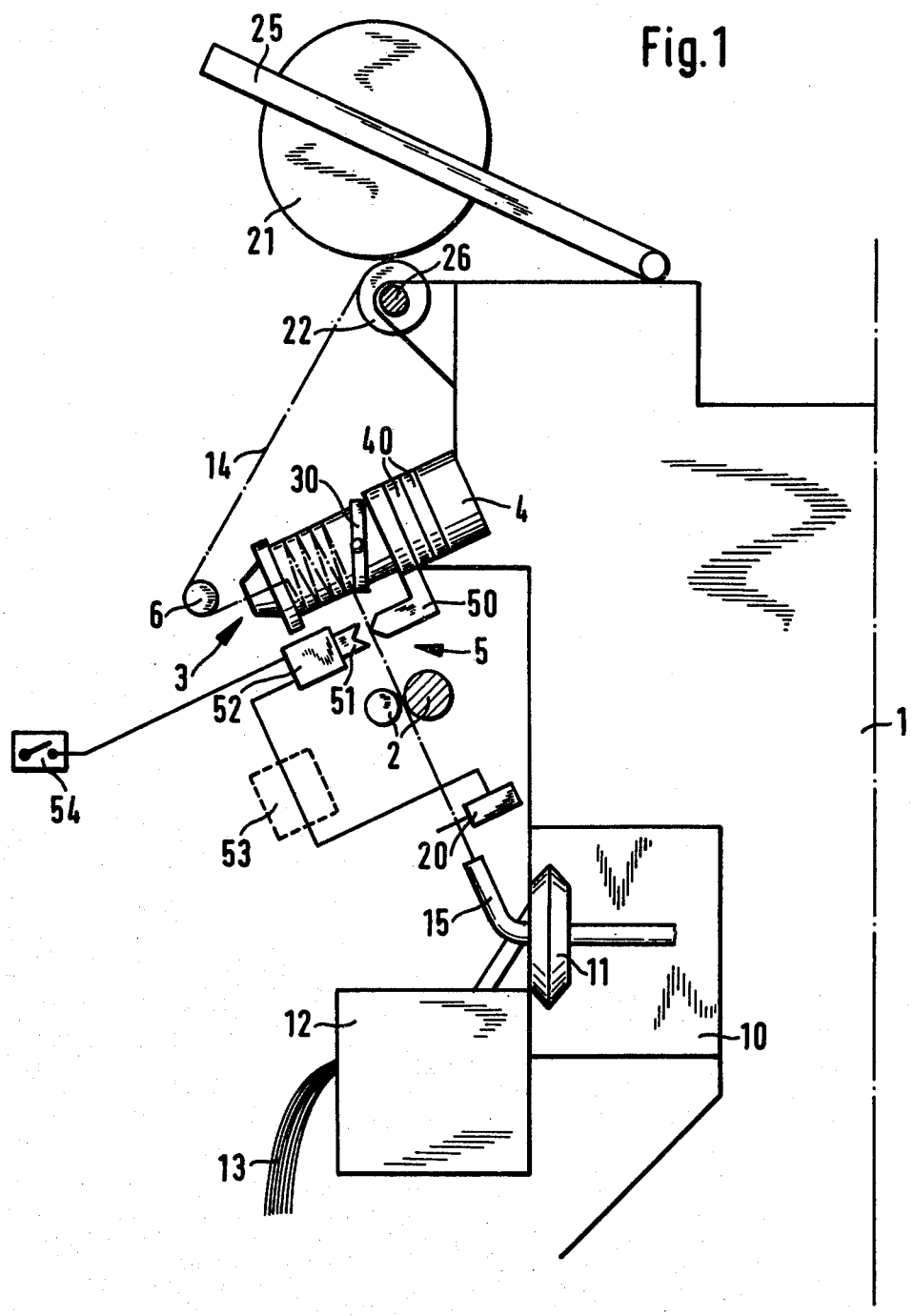
FIG. 1 shows a spinning station in a diagrammatic side view with the storage and gripping device constructed in accordance with the present invention.

According to FIG. 1, disposed on a frame 1 is a spinning apparatus which comprises a spinning compartment constructed, for example, in the form of a rotor 11 in a housing 10. The spinning compartment is fed with fibers from an opening device disposed in another housing 12. The fibers are supplied to the opening device in the form of a sliver 13.

The yarn 14 produced in the spinning compartment is withdrawn from the spinning compartment by means of delivery rollers 2 via a yarn withdrawal tube 15. A knock-off motion 20 monitors the tension of the yarn 14 and controls the opening device disposed in the housing 12 in a conventional manner, not illustrated. The yarn 14 withdrawn from the spinning compartment ultimately reaches a bobbin 21 which is driven via a winding roller 22.

In the course of the yarn, between the delivery rollers 2 and the bobbin 21, there is a roller store 3 which can be driven by means of a re-delivery drive. The re-delivery drive may vary in construction. For example, according to FIG. 1, it comprises a motor 4 and a clutch 40. The clutch can cause a reversal of the drive. Preferably, however, the re-delivery drive is constructed in the form of a slip drive, in which case the clutch 40 is a slip clutch. The yarn 14 is supplied continuously to the roller store 3 along a defined path, for example, tangentially. In the path of the yarn between the spinning compartment and the roller store 3, preferably between the delivery rollers 2 and the roller store 3, there is a yarn gripper 5. According to the embodiment shown, the yarn gripper 5 comprises a stationary gripping element 50 which is connected to the roller store 3 and a gripping element 51 which is adjustable in relation to the gripping element 50, and which is adjustable via an electromagnet 52. The electromagnet 52 is controllably connected to the knock-off motion 20 and to a switch 54.

The yarn 14 is withdrawn axially from the roller store 3 disposed substantially transversely to the yarn withdrawal direction and is deflected towards the bobbin 21 at a deflection point 6.

A certain length of yarn is always temporarily stored on the roller store 3, so that there is an equalization of yarn length for the traversing of the yarn 14 during the formation of the bobbin 21, which was hitherto a major problem, particularly in the formation of tapered bobbins 21. If a drop in tension occurs in the yarn 14 or even a yarn breakage, this is recorded by the knock-off motion 20 in known manner. In this case, the electromagnet 52 is actuated and displaces the gripping element 51 towards the gripping element 50. A timing circuit 53 is provided in one particular embodiment between knock-off motion 20 and electromagnet 52, which timing circuit actuates the electromagnet 52 depending on the yarn withdrawal speed so that the yarn 14 has already left the nip line of the delivery rollers 2 but is still within range of the yarn gripper 5. Thus, the end of the yarn is always in one and the same place for the piecing so that a tedious search for the yarn 14 is eliminated.

The roller store 3 is driven through a slip clutch, the transmitted torque being so great that, when the yarn gripper 5 is not actuated, the yarn 14 is stored on the roller store 3, but the roller store 3 is stopped when the yarn gripper 5 is actuated. For piecing the yarn, the yarn 14 is grasped and the switch 54 is actuated, as a result of which the gripping action of the yarn gripper 5 is cancelled. The gripping element 51 releases the yarn 14. Storage of the yarn 14 is prevented by holding back the yarn 14 by hand. The operator now withdraws the length of yarn needed for the piecing from the roller store 3 and introduces the yarn 14 into the yarn withdrawal tube 15 of the rotor 11. When the yarn tension is restored, the yarn 14 is introduced in known manner into the nip region of the delivery rollers 2 or the gripping action of the delivery rollers 2 is restored. In addition, the yarn storage now begins again, because the yarn 14 is neither held back by the yarn gripper 5 nor by hand, so that no counter-torque now opposes the torque produced by the slip clutch 40.

Figure 4:
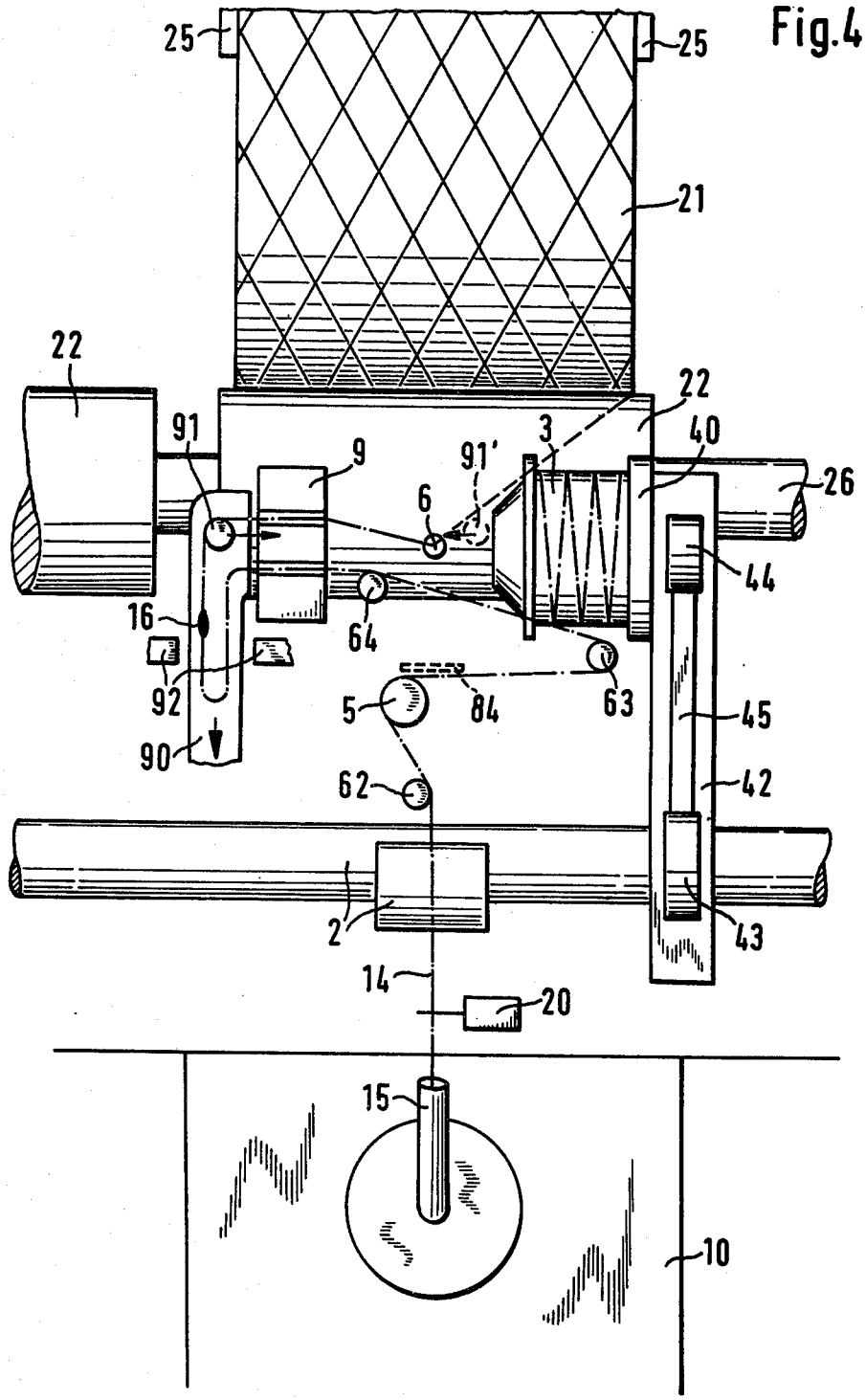
FIG. 4 shows the device constructed in accordance with the invention with a yarn seizer and a knotting device, in front elevation.

The invention can be modified in various ways. A motor 4 with a slip clutch 40 for example, may be used as a slip drive, as explained in connection with FIG. 1. The motor 4 can also be replaced by a transmission from the delivery rollers 2 (FIG. 4). For example, a lever 42 may be pivotally mounted on the roller store 5, which lever carries two rollers 43 and 44 which are connected to one another as regards drive through a belt 45 and of which the roller 43 is driven by friction by one of the delivery rollers 2. A slip clutch 40 is disposed between the roller 44 and the roller store 3.

Figure 2:
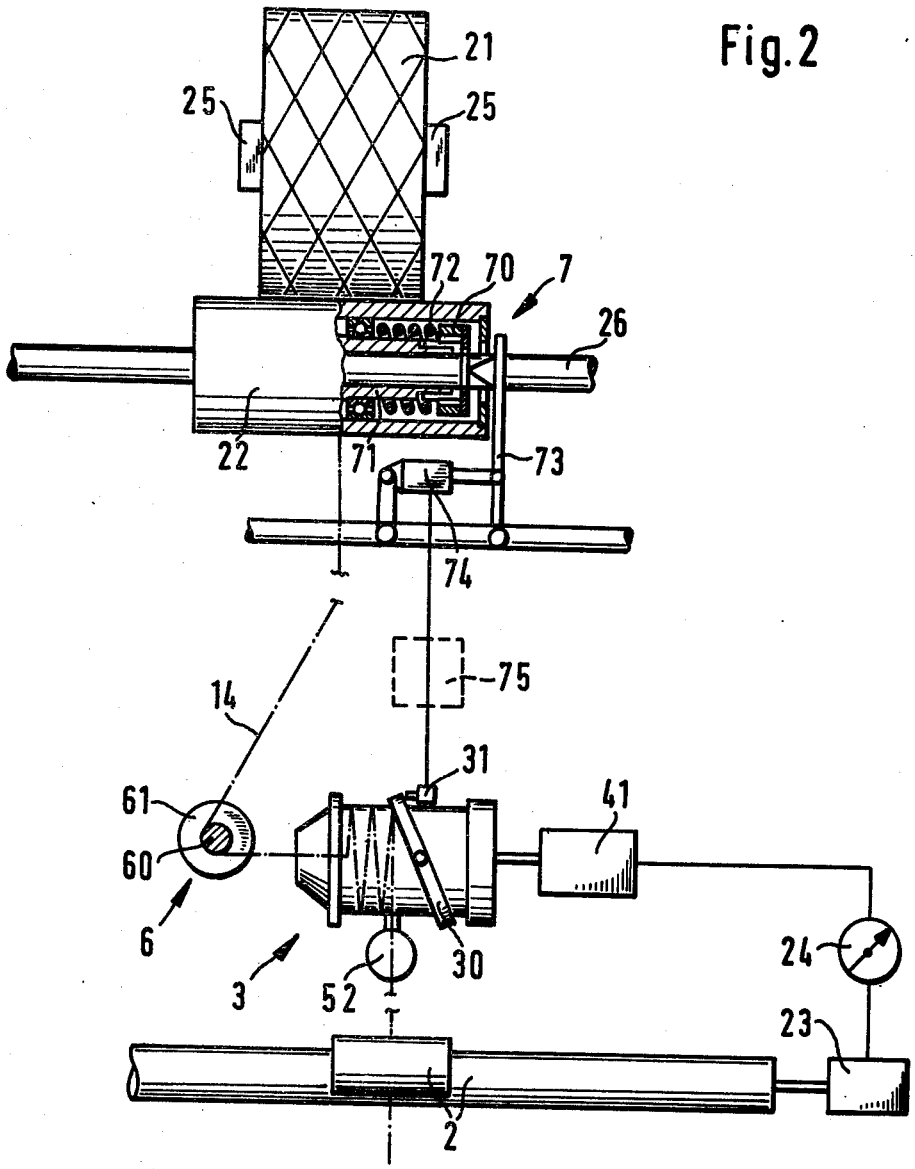
FIG. 2 shows a front view of a spinning station, in which the storage and gripping device are constructed in accordance with the invention and are illustrated together with the yarn deflection point in side elevation for graphic reasons.

It is also possible, however, and is particularly advantageous, to use an eddy-current clutch or an eddy-current drive 41 (FIG. 2). In this case, a tachogenerator 23 is preferably associated with the delivery rollers 2 and produces a control voltage for the eddy-current drive 41 depending on the yarn withdrawal speed. Another possibility for adjusting the slip drive, for example responsive to the yarn thickness, can be provided by means of a potentiometer 24 connected between eddy-current drive 41 and tachogenerator 23. If a slip clutch 40, for example, a friction clutch, is used as shown in FIG. 1, then the transmitted torque can be influenced by varying the spacing between the friction plates.

A monitor which monitors the amount of yarn stored is preferably associated with the roller store 3. This comprises a control ring 30, for example, by means of which the supply of yarn is displaced towards the free end of the roller store 3. The monitor further includes a switch 31. If the supply of yarn on the roller store 3 becomes greater, the control ring 30 is pivoted and actuates the switch 31.

Another construction of the monitor monitoring the supply of yarn is also possible, so that the invention is not restricted to the embodiment of the monitor shown. For example, the monitor may comprise a sprung arm which is covered by the supply of yarn and is urged radially inwards against the action of the spring. If the supply of yarn becomes too small, the spring overcomes the yarn tension and urges the sprung arm outwards. The sprung arm is part of the switch 31 or actuates this, so that the switch 31 is again actuated depending on the size of the supply of yarn.

This switch 31 is connected, as regards control, with a device for interrupting the winding operation. This device may vary in construction. For example, it may comprise a lifting device for the bobbin holder 25 in order to lift the bobbin 21 from the winding roller 22 and to interrupt the winding in this manner. Pattern turns on the bobbin 21 are also prevented by this alteration between winding and stopping of the winding.

It is not necessary, however, for the bobbin 21 to be lifted from the winding roller 22. According to FIG. 2, the winding roller 22 is connected, via a clutch 7, to the winding shaft 26 extending over a plurality of spinning stations. The clutch 7 comprises a clutch half 70 connected to the winding roller 22 and a clutch half 71 connected to the winding shaft 26. In the embodiment shown, the clutch half 71 is urged towards the clutch half 70 by a compression spring 72. The clutch half 71 can, however, be moved away from the clutch half 70 by means of a rocking lever 73 so that the driving connection between the winding shaft 26 and the winding roller 22 is interrupted. The rocking lever 73 is controlled by an electromagnet 74 which is connected to the switch 31 as regards control. If the switch 31 records a decrease in the supply of yarn on the roller store 3, then the electromagnet 74 is energized. The electromagnet 74 actuates the rocking lever 73 which lifts the clutch half 71 from the clutch half 70.

If desired, a brake may also be connected to the rocking lever 73, which brake acts on the winding roller 22 when the clutch is in the disengaged position to stop the roller 22. The drive of the bobbin 21 is interrupted by this means, so that the supply of yarn builds up again on the roller store 3. After release of the switch 31 or when a timing circuit 75 is utilized, after the expiration of a certain period of time, the electromagnet 74 is again de-energized so that the compression spring 72 again brings the clutch half 71 into engagement with the clutch half 70 and the winding roller 22 and, hence, the bobbin 21 is driven again.

An electromagnetic clutch may also be used instead of a mechanical clutch for the drive of the winding roller 22.

The roller store 3 can be disposed with various orientation between the delivery rollers 2 and the winding device 22, 21. Depending on the arrangement and orientation of the roller store 3, a deflection point 6 is provided before or after or both and after the roller store 3. According to FIG. 2, the roller store 3 is disposed substantially transversely to the yarn withdrawal direction so that the yarn 14 is supplied to the roller store 3 without deflection. A deflection is only effected after leaving the roller store 3. The deflection point 6 disposed between roller store 3 and winding device 22, 21 may be constructed in the form of a yarn brake. For example, two plate discs 61 are disposed on a spindle 60 and can be pressed against one another by means of a compressing spring (not shown). The gripping force can be varied by adjusting the initial tension of the spring. The yarn brake may also be constructed differently however, for example, in the form of a lattice brake, in which case the restraining force can be influenced by adjusting two comb lattices in relation to one another. By means of the deflection point 6 constructed in the form of a yarn brake, a restraining force is exerted on the yarn 14, and by adjusting this yarn brake, the winding tightness can be varied and so indirectly adjusted.

Figure 3:
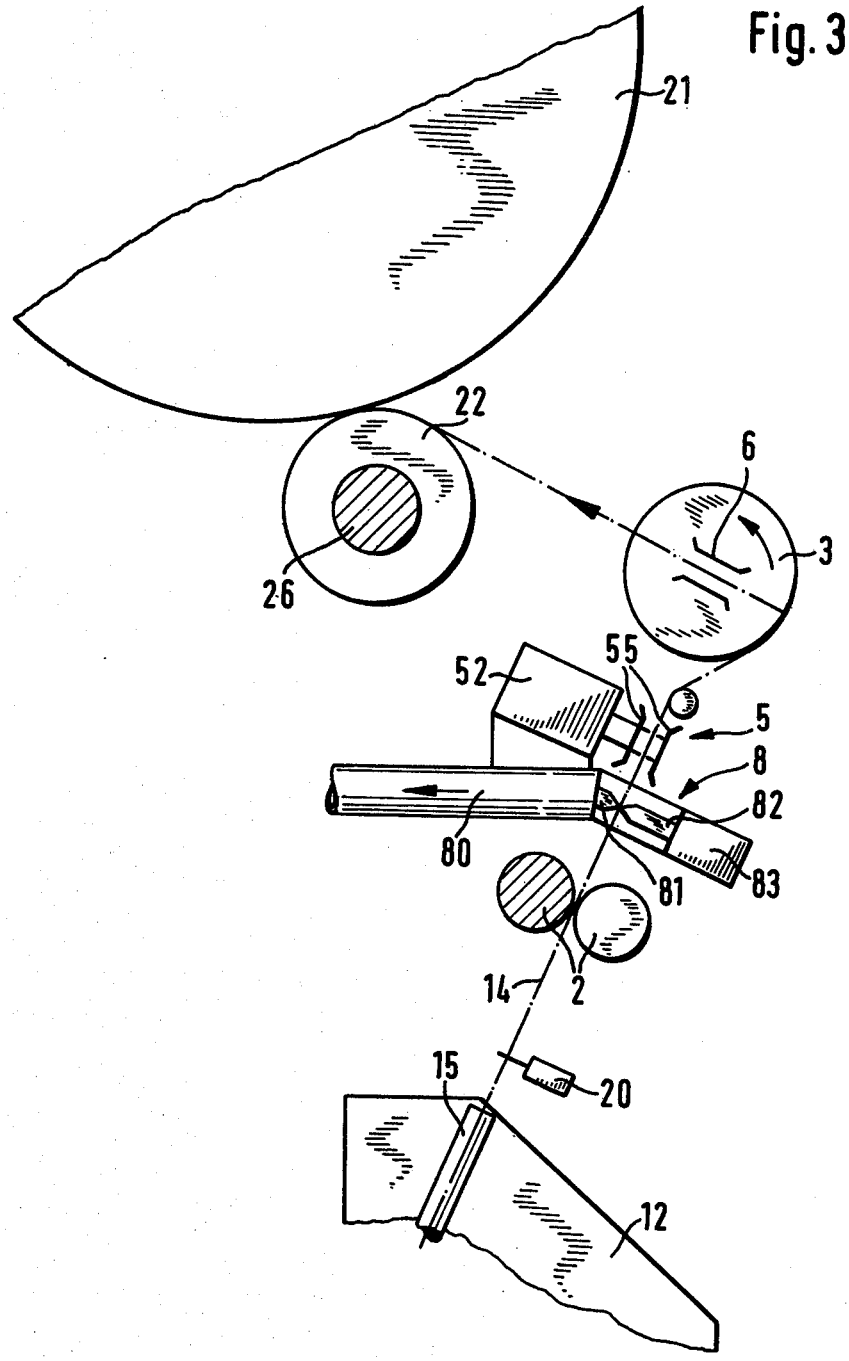
FIG. 3 shows an open-end spinning apparatus with a cutting and suction device in front of the gripping device, in side elevation.

According to FIG. 1, a timing circuit 53 is provided for the actuation of the yarn gripper 5. This timing circuit 53 should be adjusted to the speed of the delivery rollers 2 in order to ensure that the yarn 14 is caught at the correct time by the yarn gripper 5 at every withdrawal speed. The end of the yarn should neither be too short, because otherwise it is difficult for the operator to grasp, nor should it be too long because otherwise, after release by the delivery rollers 2, it jumps together and forms knots. The control of the timing circuit 53 depending on the speed of the delivery rollers requires increased expenditure on control, however. In order to avoid this, according to FIG. 3, a yarn cutting device 8 in conjunction with a suction device 80 is provided in the path of the yarn between the delivery rollers 2 and the yarn gripper 5. The yarn cutting device 8 comprises, for example, a stationary knife 81 and a movable counter knife 82 which is controlled by an electromagnet 83. The yarn gripper 5 which, according to FIG. 3, is constructed in the form of plate discs 55 which can be pressed against one another, and is controlled by the knock-off motion 20. At the same time, the suction device 80 and the electromagnet 83 of the yarn cutting device 8 are actuated. Thus the yarn 14 is severed at a defined distance from the yarn gripper 5 and the parted-off end of the yarn, which is subsequently delivered by the delivery rollers 2, is sucked up and taken away by the suction device 80. Thus, a yarn end of defined length results. The distance between yarn cutting device 8 and yarn gripper 5 is selected so that the yarn 14 is easily accessible, so that the operator can grasp it easily for the following piecing. On release of the yarn gripper 5, the suction device 80 and the yarn-cutting device 8 are put out of operation.

According to FIG. 4, associated with the yarn gripper 5 is a yarn seizer 84 by means of which the end of the yarn can be supplied to the yarn withdrawal tube 15. A yarn guide may also be provided instead of a yarn seizer 84. For the sake of simplicity, only the mode of operation with a yarn seizer 84 will be described below. This can vary in construction and work mechanically or pneumatically. It may also be used in combination with a yarn cutting device 8 and a suction deviece 80 as shown in FIG. 3. The yarn seizer 84 is normally in a waiting position between yarn cutting device 8 and yarn gripper 5, out of which position it is moved to the mouth of the yarn withdrawal tube 15. Shortly after reaching the yarn 14, the yarn seizer 84 is actuated to grasp the yarn 14 and the yarn gripper 5 is opened. The yarn seizer 84 releases the yarn 14 in the lower position in the region of the mouth of the yarn withdrawal tube 15. The yarn 14 is now sucked, under the action of the stream of air drawn into the yarn withdrawal tube 15, into the interior of the rotor 11 (FIG. 1), where it is connected to the fiber ring by centrifugal force.

The yarn seizer 84 may advantageously be constructed in the form of a pivotal vacuum nozzle so that this can also replace the stationary suction device 80. Mounted at a specific distance from the mouth of the pneumatic yarn seizer 84, in the suction tube of the yarn seizer, is the yarn cutting device 8, so that the yarn seizer 84 holds the end of the yarn brought to a specific length securely during the pivotal movement. For the transfer of the yarn 14 to the stream of intake air acting in the yarn withdrawal tube 15, the stream of intake air in the yarn seizer 84 is stopped when the yarn seizer 84 is in the region of the yarn withdrawl tube 15.

The yarn seizer 84 can also be disposed in a waiting position between yarn gripper 5 and roller store 3, as FIG. 4 shows. This time also, as in the case previously described, the yarn gripper 5 can be controlled depending on the movement of the yarn seizer 84. For example, the yarn seizer 84 may be in a waiting position in extension of the straight line extending through the mouth of the yarn withdrawal tube 15 and the nip line of the delivery rollers 2, for which purpose, apart from the yarn gripper 5 constructed in the form of a deflection point, a further deflection point 62 is disposed between delivery rollers 2 and yarn seizer 84, and a deflection point 63 is disposed between yarn seizer 84 and roller store 3. The electromagnet 52 of the yarn gripper 5 may respond briefly depending on the yarn tension sensed by the knock-off motion 20, whereupon the yarn gripper 5 is self-holding by means of a mechanical locking means, not shown. After the beginning of the pivotal motion of the yarn seizer 84, this then actuates the locking means causing the yarn gripper to release the yarn. In certain circumstances, however, the yarn seizer 84 can also take over the task of the yarn gripper 5 or be combined with such a one, so that the yarn gripper 5 can be constructed in the form of a simple deflection point.

According to a further feature of the invention, a knotting device 9 with a suction device 90 at its side remote from the deflection point 6 is provided between the deflection point 6 and the winding device consisting of winding roller 22 and bobbin 21. The yarn 14 can be supplied to the knotting device 9 and the suction device 90 through a feed loop 91 which is in the waiting position beyond the deflection point 6 at the side of the path of the yarn remote from the knotting device 8. Through one or more additional deflection points 64 disposed between roller store 3 and knotting device 9, the yarn 14 is conveyed out of the waiting position during the movement of the feed loop 91 and introduced into the mouth of the suction device 90 in the knotting device 9.

In the embodiment of the invention shown, the knotting device 9 is disposed substantially in extension of the axis of the roller store 3. It is also possible, however, to dispose the knotting device 9 elsewhere. Then, too, a satisfactory feed of the yarn 14 is achieved by suitable movement of the feed loop 91 and by appropriate arrangement of deflection points 64. For example, the knotting device 9 with the suction device 90 may be mounted on a carriage which can travel along the machine to the spinning station which signals a yarn breakage so that the yarn 14 is deflected out of the plane of the Figure, perpendicular to the observer. Apart from the knotting device 9 and the suction device 90, the carriage may also carry the yarn seizer 84 with a mechanical yarn gripper, which is provided in addition to the yarn gripper 5. But even if the yarn seizer 84 is not mounted on the carriage, it is an advantage if, in addition to the mechanical yarn gripper, a stationary yarn gripper 5 is provided on the yarn seizer 84 so as to be able to deal with a plurality of yarn breakages following directly one on the other, even if the thread seizer 84 has not yet returned to its waiting position.

During undistrubed spinning operation, the yarn 14 is withdrawn from the rotor 11 (FIG. 1) through the delivery rollers 2 and supplied, via the deflection points 62 and 63, to the roller store 3. Here, within certain limits, a supply of yarn is always stored which is monitored by a suitable monitor. The bobbin 21 is driven depending on the size of the supply of yarn. If a yarn breakage occurs, the knock-off motion 20 reports this to the fiber feed device, not shown, to the yarn gripper 5 and to the yarn seizer 84. The fiber feed is stopped. The yarn gripper 5 grasps the yarn 14. If necessary, a control pulse is passed to a carriage which now travels to the spinning station in question. If the yarn seizer 84 is in its waiting position, the stream of intake air is switched on and the yarn 14 brought into the yarn seizer 84, at the mouth of which another yarn gripper is mounted. The yarn 14 further delivered by the delivery rollers 2 is sucked into the yarn seizer 84 and severed after a fixed time so that the yarn end can be carried away pneumatically.

As a result of the gripping of the yarn 14 in the yarn gripper 5, further storage of the yarn 14 on the roller store 3 is prevented. When a certain minimum amount of supply is reached, the bobbin 21 is accordingly disconnected from its drive.

At a fixed interval in time after response of the knock-off motion 20 (timing circuit 53 - FIG. 1) or after actuation of a switch 54, the yarn gripper 5 is opened and the yarn seizer 84 is moved to the mouth of the yarn withdrawal tube 15, where the yarn gripper on the yarn seizer 84 is opened and the stream of intake air acting in the yarn seizer 84 is switched off so that the yarn 14 is released. The switch 54 may be actuated by hand or by a timing circuit from the carriage which carries the knotting device 9 and the suction device 90. As a result of the intake air acting in the yarn withdrawal tube 15, the yarn 14 is drawn into the rotor 11 (FIG. 1), where it establishes contact with the fiber ring. The knock-off motion 20 detects the restoration of the yarn tension and switches on the fiber feed, if this has not already been switched on previously by a timing circuit.

The freshly produced yarn 14 is now introduced into the nip line of the delivery rollers 2 by the restored tension directly or by means of additional control members. Since no restraining moment is any longer exerted on the yarn 14, the yarn 14 is now again stored on the roller store 3.

The feed loop 91 is now guided out of its position 91' past the knotting device 9 into the suction device 90 or past its mouth. At the same time, reduced pressure is produced in the suction device 90, as a result of which the supply of yarn stored on the roller store 3 is drawn off by suction. By means of a yarn monitor 92 on the suction device, which is constructed, for example, in the form of a light barrier, it is determined when the piecing point 16 is in the suction device 90. When the bobbin 21 is driven again as a result of an adequate supply of yarn being reached, it is stopped again by the complete using up of the yarn reserve on the roller store 3. The feed loop 91 travels back into the position 91', or at least to the side of the knotting device 9 adjacent to the roller store 3.

When the piecing point 16 is in th suction device 90, the knotting device 9 is set in operation, while the yarn 14 which continues to be supplied, is accumulated on the roller store 3 because no more yarn 14 is withdrawn from the roller store 3 during the knotting operation. After the knotting operation is completed, the yarn present in the suction device 90 is severed from the remaining yarn 14 and carried away, after which the reduced pressure in the suction device 90 is stopped. The yarn 14 released by the suction device 90 now passes round the deflection point 6. After a certain length of supply yarn is reached, the bobbin 21 is also driven again.

If desired, the knotting device 9 may also be adapted for switching off. This can be effected by interrupting the drive for the feed loop 91. If the yarn seizer 84 is mounted stationary at the individual spinning stations, the current connection alerting the carriage with the knotting device 9 can also be interrupted. A plurality of such current connections may also be provided for differently adjusted knotting devices 9 which are merely allocated to certain spinning stations.

As the above description shows, the subject of the invention can be modified in many ways. The control of the yarn gripper 5 and of the winding device 22, 21 may be effected directly or through a timing circuit 53 or 75. The drive device for the bobbin 21 and the manner of interrupting its drive may also vary in construction. Nevertheless, the advantage that a relatively large amount of yarn can be temporarily stored by means of the roller store 3 with the appearance of the yarn unaltered, is common to all the embodiments of the device according to the invention. Moreover, on the occurrence of a yarn breakage, the end of the yarn is at a defined point and is immediately available for the fresh piecing of the yarn, without first having to be sought for a long time.

If a stationary knotting device 9 is supplied to the apparatus according to one embodiment of the invention for each spinning station, then common commencement of spinning for a plurality of spinning stations can also be carried out with such a combined apparatus. For this purpose, the piece of yarn held by the yarn gripper 5 is supplied to the yarn withdrawal tube 15 of the spinning compartment by the yarn seizer 84 in the manner previously described. When the knotting device 9 has reached the piecing point after the yarn has been placed in position, this is eliminated by knotting as when repairing a yarn breakage. By the elimination of the starting piece and of the thick and thin portions, quality bobbins can be produced with the apparatus according to the present invention.

Depending on the equipment of the spinning stations with knotting devices 9 or depending on the construction of a carriage with one or more knotters, the commencement of spinning can be carried out simultaneously or in succession for all the spinning stations of the machine, one side or one section.

While a preferred embodiment of the invention has been described using specific terms, such description is for illustrative purposes only, and it is to be understood that changes and variations may be made without departing from the spirit or scope of the following claims.

What is claimed is:

1. In an open-end spinning apparatus wherein yarn is produced in a spinning compartment and withdrawn therefrom by yarn withdrawal rollers and a winding device, a yarn storage device interposed between said yarn withdrawal rollers and said winding device and a knock-off motion positioned between said spinning compartment and said yarn withdrawal rollers for producing a signal responsive to changes in tension in said yarn, the improvement comprising:

(a) said yarn storage device including:

(i) a roller storage, (ii) means for driving said roller storage in a forward direction for storing yarn thereon during normally running of said open-end apparatus and permitting said roller storage to be rotated in a reverse direction for withdrawing yarn therefrom during piecing up operation, (b) said yarn being produced in said spinning compartment following a path from said spinning compartment, past said knock-off motion, around said roller storage to be wound on said winding device;

(c) a yarn gripper carried between said yarn storage roller and said yarn withdrawal roller, operably connected to said knock-off motion for gripping said yarn and holding said yarn in a generally stationary position responsive to receiving said signal from said knock-off device indicating a change in tension in said yarn;

whereby said yarn extending between said yarn gripper and said yarn storage device can be readily grasped and withdrawn from said roller store for insertion in said spinning compartment when a breakage in said yarn occurs.

2. The apparatus as set forth in claim 1 wherein said yarn gripper comprises:

(a) yarn seizing means for inserting said gripped yarn into said spinning compartment.

3. The apparatus as set forth in claim 1 further comprising:

(a) A yarn cutting device disposed between said yarn withdrawal rollers and said yarn gripper, and (b) a suction device positioned adjacent said yarn cutting device for holding the end of the yarn after being cut by said yarn cutting device.

4. The apparatus as set forth in claim 1 wherein said means for driving said roller storage in a forward direction and permitting said roller storage to be rotated in a reverse direction includes a slip drive.

5. The apparatus as set forth in claim 4 wherein said slip drive is an eddy current drive.

6. The apparatus in accordance with claim 1 further comprising:

(a) a monitor for monitoring the amount of yarn stored on said roller storage and generating a signal responsive thereto; and (b) means for controlling the speed of said winding device responsive to said signal produced by said monitor.

7. The apparatus as set forth in claim 6 wherein (a) an individual winding roller is provided per spinning station on said open-end spinning apparatus, (b) a winding shaft extending over a plurality of said spinning stations, and (c) controllable clutch means for selectively connecting said winding rollers to said winding shaft.

8. In an open-end spinning apparatus having a spinning compartment in which yarn is produced, driven rollers withdrawing said yarn from said spinning compartment for being wound on a winding device, a yarn storage device disposed between said driven rollers and said winding device, a knock-off motion position between said spinning compartment and said driven rollers producing a signal responsive to a change in tension in said yarn, said improvement comprising:

(a) said yarn storage device including, (i) a roller storage, and (ii) means for driving said roller storage device in a forward direction for storing yarn thereon and feeding said yarn to said winding device during normally running of said open-end spinning apparatus and for permitting said yarn to be pulled off said roller storage in a reverse direction in order to piece up said yarn, (b) said roller storage being disposed substantially transversely to the path of travel of said yarn between said spinning compartment and said winding device, (c) a yarn deflection means positioned between said roller storage device and said winding device for deflecting said yarn coming off said roller storage device towards said winding device, and (d) a yarn disposed between said driven yarn withdrawal rollers and said roller storage operably connected to said knock-off motion for gripping said yarn responsive to receiving said signal from said knock-off motion indicating a change in tension in said yarn, whereby said yarn extending between said yarn gripper and said yarn storage device can be readily grasped and withdrawn from said roller storage for insertion in said spinning cmpartment when a breakage in said yarn occurs.

9. The open-end spinning apparatus as set forth in claim 8 further comprising:

(a) a knotting device provided between said yarn deflection means and winding device, (b) a suction means carried on a side of said knotting device remote from said deflection means, and (c) means for supplying said yarn to said knotting device and said suction means in the form of a loop.

10. The openend spinning apparatus as set forth in claim 8 wherein said yarn deflection means is constructed as a yarn brake.

* * * * *